US011930925B2

(12) United States Patent
Silverman et al.

(10) Patent No.: US 11,930,925 B2
(45) Date of Patent: Mar. 19, 2024

(54) INTEGRAL FURNITURE ITEM CONVERTIBLE BETWEEN A SITTING BENCH AND A TABLE

(71) Applicants: David Silverman, Washington, DC (US); Eylon Winterstein, Medford, NJ (US)

(72) Inventors: David Silverman, Washington, DC (US); Eylon Winterstein, Medford, NJ (US)

( * ) Notice: Subject to any disclaimer, the term of this patent is extended or adjusted under 35 U.S.C. 154(b) by 153 days.

(21) Appl. No.: 17/577,011

(22) Filed: Jan. 17, 2022

(65) Prior Publication Data

US 2022/0248844 A1 Aug. 11, 2022

Related U.S. Application Data

(60) Provisional application No. 63/146,310, filed on Feb. 5, 2021.

(51) Int. Cl.
*A47B 85/04* (2006.01)

(52) U.S. Cl.
CPC ..... *A47B 85/04* (2013.01)

(58) Field of Classification Search
USPC ..... 297/125
See application file for complete search history.

(56) References Cited

U.S. PATENT DOCUMENTS

| | | | | |
|---|---|---|---|---|
| 323,872 | A * | 8/1885 | Koskul | A47C 13/00 297/125 |
| 342,343 | A * | 5/1886 | Farrell | A47C 13/00 297/125 |
| 1,468,817 | A * | 9/1923 | Jones | A47C 13/00 297/125 |
| 1,703,981 | A * | 3/1929 | Armstrong | A47C 13/00 297/125 |
| 1,773,791 | A * | 8/1930 | Rohrmann | A47B 85/04 297/125 |
| 4,662,675 | A * | 5/1987 | Volpi | A47C 13/00 297/320 |
| 5,179,745 | A * | 1/1993 | Hebert | A61G 5/1059 5/81.1 R |
| 6,464,297 | B2 * | 10/2002 | Garrido | B60N 2/206 297/354.11 |

(Continued)

FOREIGN PATENT DOCUMENTS

WO WO-2012006941 A1 * 1/2012 ..... B60N 2/206

*Primary Examiner* — David E Allred
(74) *Attorney, Agent, or Firm* — Barry Choobin; Patent 360

(57) ABSTRACT

A multi-functional, space-saving, and economical furniture item, made of wood, that converts shape and function to provide storage, seating, a desk-top workspace, and a countertop-height workspace. The furniture item is a bench that provides seating and has a flap that can be "actioned" (folded down) to provide a table for writing. The bench is integrally formed in a unitary structure that affords multimodal transformation and practicality for ease-of-use and desired functional range. By lifting the bench seat clockwise and lowering the backrest, the furniture item transforms into a countertop or a desktop workspace. Undoing the said steps transforms the countertop back to the bench.

16 Claims, 8 Drawing Sheets

(56) References Cited

U.S. PATENT DOCUMENTS

| | | | | |
|---|---|---|---|---|
| 7,207,625 | B1 * | 4/2007 | Hardt, II | A47C 3/18 297/125 |
| 8,109,565 | B2 * | 2/2012 | Waters | B60N 2/305 297/125 |
| 11,457,734 | B2 * | 10/2022 | Cheon | A47B 23/06 |
| 2010/0123338 | A1 * | 5/2010 | Waters | B60N 3/001 297/125 |
| 2014/0152065 | A1 * | 6/2014 | Boehm | B60N 2/22 297/337 |

* cited by examiner

INTEGRAL FURNITURE ITEM CONVERTIBLE BETWEEN A SITTING BENCH AND A TABLE

CROSS-REFERENCE TO RELATED APPLICATIONS

This application claims priority from the U.S. provisional patent application Ser. No. 63/146,310, filed on Feb. 5, 2021, which is incorporated herein by reference in its entirety.

FIELD OF INVENTION

The present invention relates to convertible furniture items, and more particularly, the present invention relates to an integral furniture item that converts between a desk and a sitting bench.

BACKGROUND

Furniture is an essential element of interior design. The most used furniture item both indoors and outdoors is a chair that allows a person to sit in a comfortable position. A table or desk is the next most used furniture item after the chair that is used to keep an article or object at a reachable height. Both the chair and the desk are available in a range of designs to cater to the different needs of the people. Convertible furniture items are known in the art that convert shape and function to provide more than one utility. Convertible furniture offers several advantages such as saving cost and space.

Convertible furniture items are popular, however, the conversion mechanism for transforming between the two furniture shapes is generally complex. A convertible furniture item that converts shape and function to provide seating and desk-top workspace has a complex construction making it difficult to use and costlier. Also, the existing conversion mechanisms require manufacturing the furniture in parts that are disassembled, rearranged, and assembled to switch between the chair and the table.

There currently exists an industry need for new convertible furniture items that convert shape and function to provide storage, seating, a desk-top workspace, and a countertop-height workspace.

SUMMARY OF THE INVENTION

The following presents a simplified summary of one or more embodiments of the present invention to provide a basic understanding of such embodiments. This summary is not an extensive overview of all contemplated embodiments and is intended to neither identify critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to a furniture item that can quickly and easily transform between a sitting bench and a table.

It is another object of the present invention that the furniture item is integral and does not require disassembly and reassembly.

It is still another object of the present invention that the bench can have a seating capacity of more than one.

It is yet another object of the present invention that the table can have a large tabletop area.

It is a further object of the present invention that a single person can transform the furniture between the bench and the table without any strain.

It is still a further object of the present invention that the table can have a standard height.

In one aspect, disclosed is a multi-functional, space-saving, and economical furniture item that converts shape and function to provide storage, seating, a desk-top workspace, and a countertop-height workspace. The convertible furniture item can include a frame having a left side panel, a right side panel, and a horizontal support that extends between the left side panel and the right side panel, the horizontal support has a proximal end and a distal end; a seat flap panel mounted to the horizontal support, wherein a front side of the seat flap panel is pivotally coupled to the proximal end of the horizontal support such that the seat flap panel can pivot from a horizontal position upwards and clockwise to an upright position, the seat flap panel has a top surface and a bottom surface, wherein the top surface of the seat flap panel forms a seat of the bench; a backrest comprising an upper backrest panel and a lower backrest panel, the lower backrest panel fixedly coupled to the distal end of the horizontal support, the upper backrest panel has a top side and a bottom side, the bottom side of the upper backrest panel pivotally coupled to a top side of the lower backrest panel such that the upper backrest panel can pivot clockwise and positioned on a rear side of the seat flap panel that is in the upright position, wherein the backrest is configured to support a back of a person sitting on the bench, and wherein the upper backrest panel configured to form a tabletop of the table.

In one implementation of the convertible furniture, the convertible furniture comprises an extension panel pivotally coupled to the top side of the upper backrest panel, the extension panel configured to be turned clockwise 180 degrees to form an extended tabletop. The seat flap panel can be pivotally coupled to the horizontal support through a first hinge joint. The upper backrest panel can be pivotally coupled to the lower backrest panel through a second hinge joint. The extension panel can be pivotally coupled to the upper backrest panel through a third hinge joint.

In one implementation of the convertible furniture item, the upper backrest panel further comprises a stopper block positioned adjacent to the top side of the upper backrest panel and extends along a length of the upper backrest panel, wherein the stopper block is configured to juxtapose to the bottom surface of the seat flap panel that is in the upright position and the upper backrest panel is placed upon the rear side of the seat flap panel, wherein the stopper block prevents an inward movement (anti-clockwise) of the seat flap panel from the upright position to the horizontal position.

In one implementation of the convertible furniture, the convertible furniture item can further include a left armrest coupled to the left-side panel and a right armrest coupled to the right-side panel. One or more storage compartments can be disposed within the frame. The one or more storage compartments can include one or more drawers slidably mounted into the frame and below the horizontal support.

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, the reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is to describe particular embodiments only and is not intended to be limiting of embodiments of the invention. As used herein, the singular forms "a", "an", and "the" are intended to include the plural forms as well, unless the context indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely to illustrate the general principles of the invention since the scope of the invention will be best defined by the allowed claims of any resulting patent.

Figure 1:
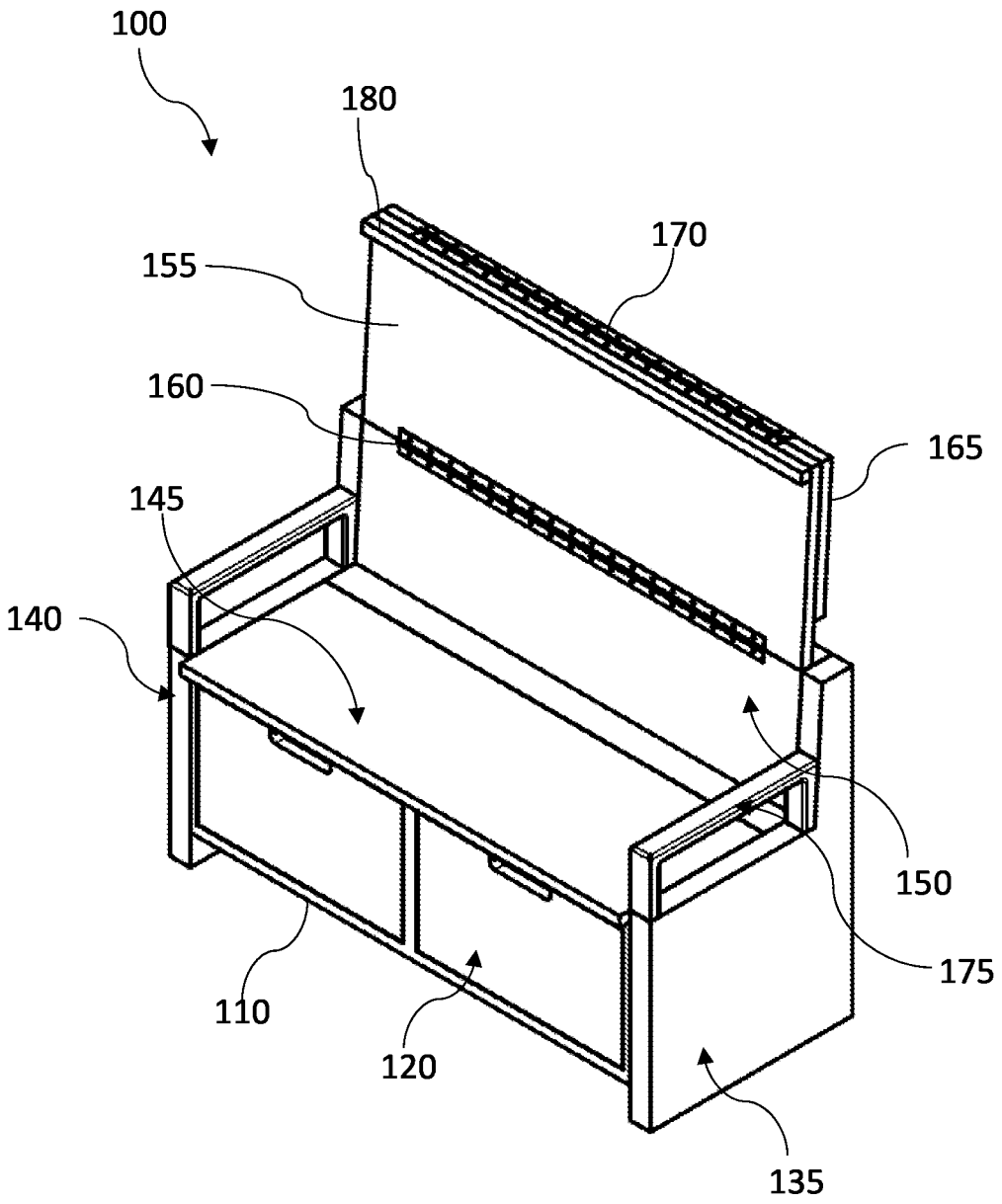
FIG. 1 is a perspective view of the disclosed convertible furniture item, according to an exemplary embodiment of the present invention.
Figure 2:
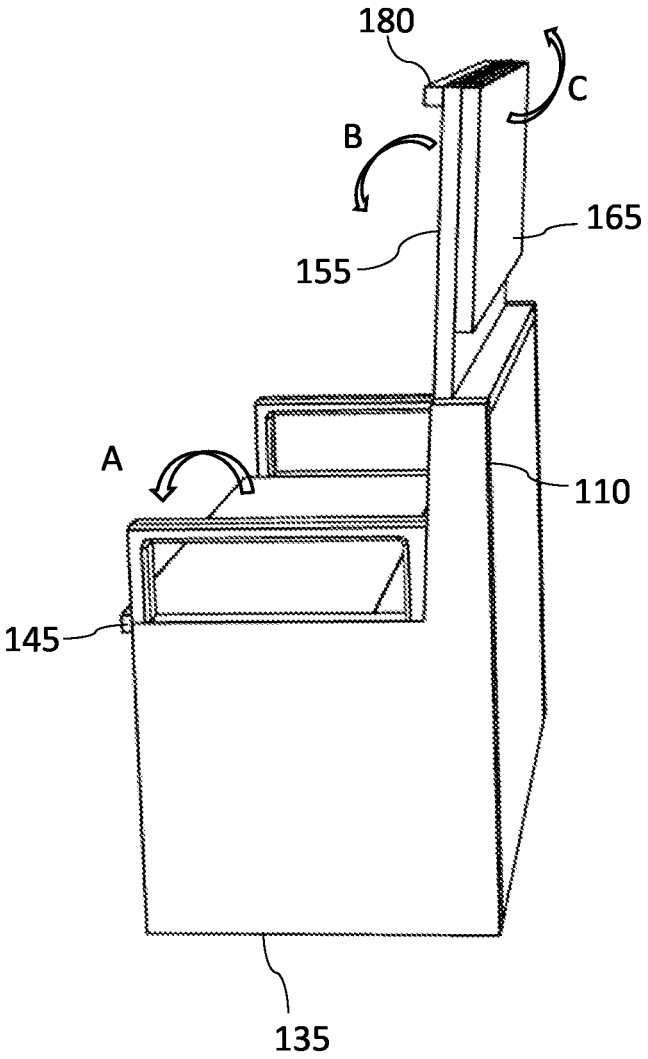
FIG. 2 is a side perspective view of the convertible furniture item, wherein arrows show the direction of movement of the panels for transforming the bench into the table, according to an exemplary embodiment of the present invention.
Figure 3:
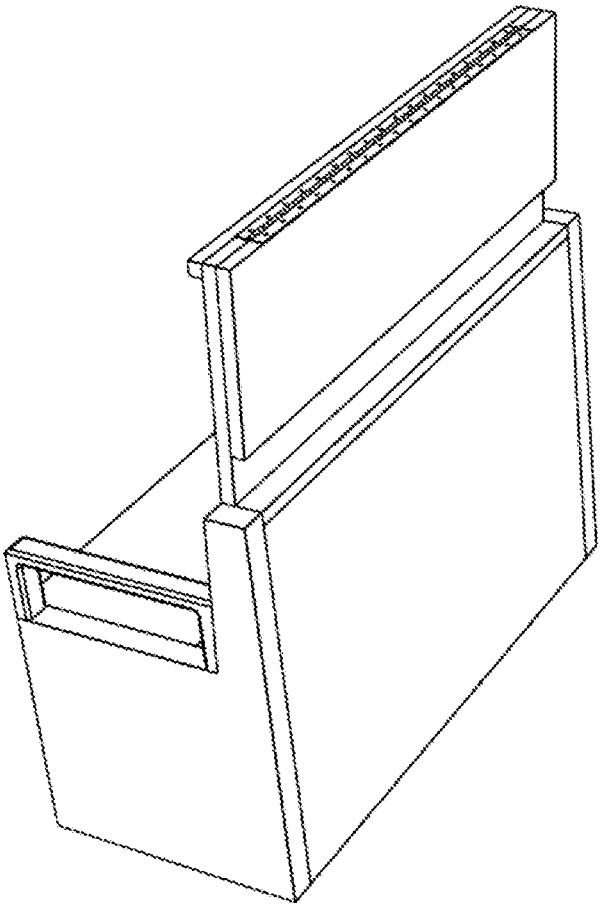
FIG. 3 is a rear perspective view of the convertible furniture item showing the extension panel, according to an exemplary embodiment of the present invention.
Figure 4:
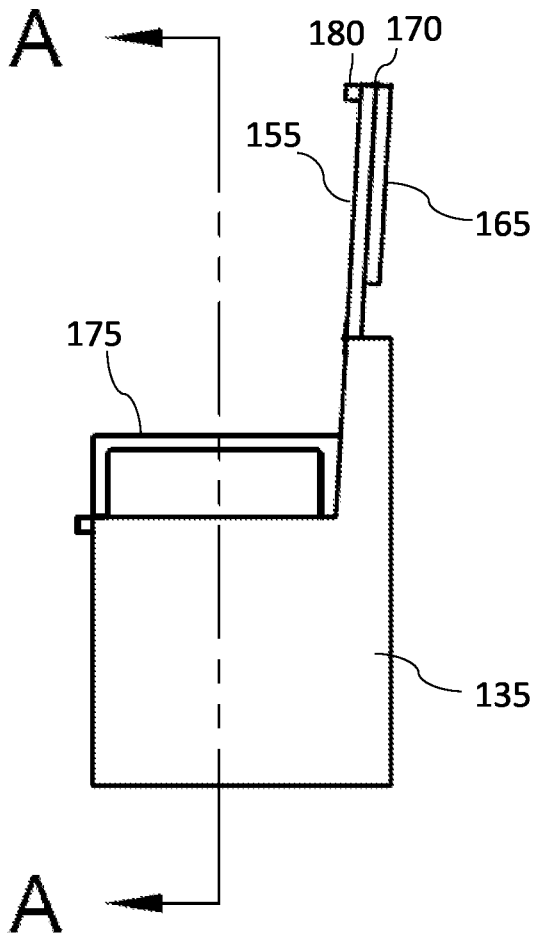
FIG. 4 is a side view of the convertible furniture item, according to an exemplary embodiment of the present invention.
Figure 4A:
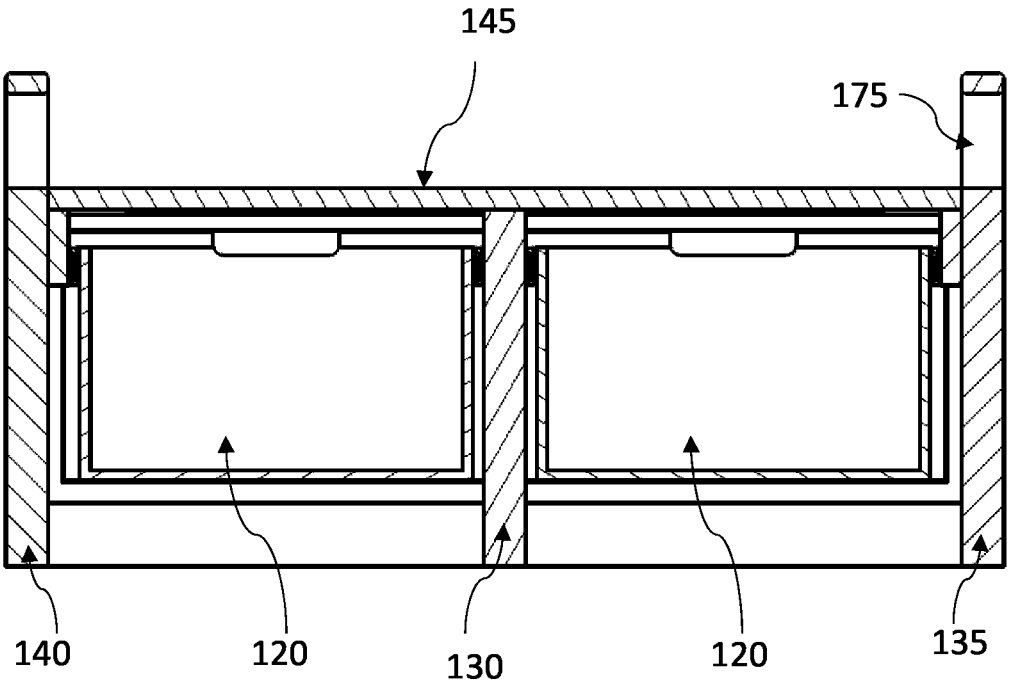
FIG. 4A is a cross-section view of the convertible furniture item taken along A-A in FIG. 4, according to an exemplary embodiment of the present invention.
Figure 5:
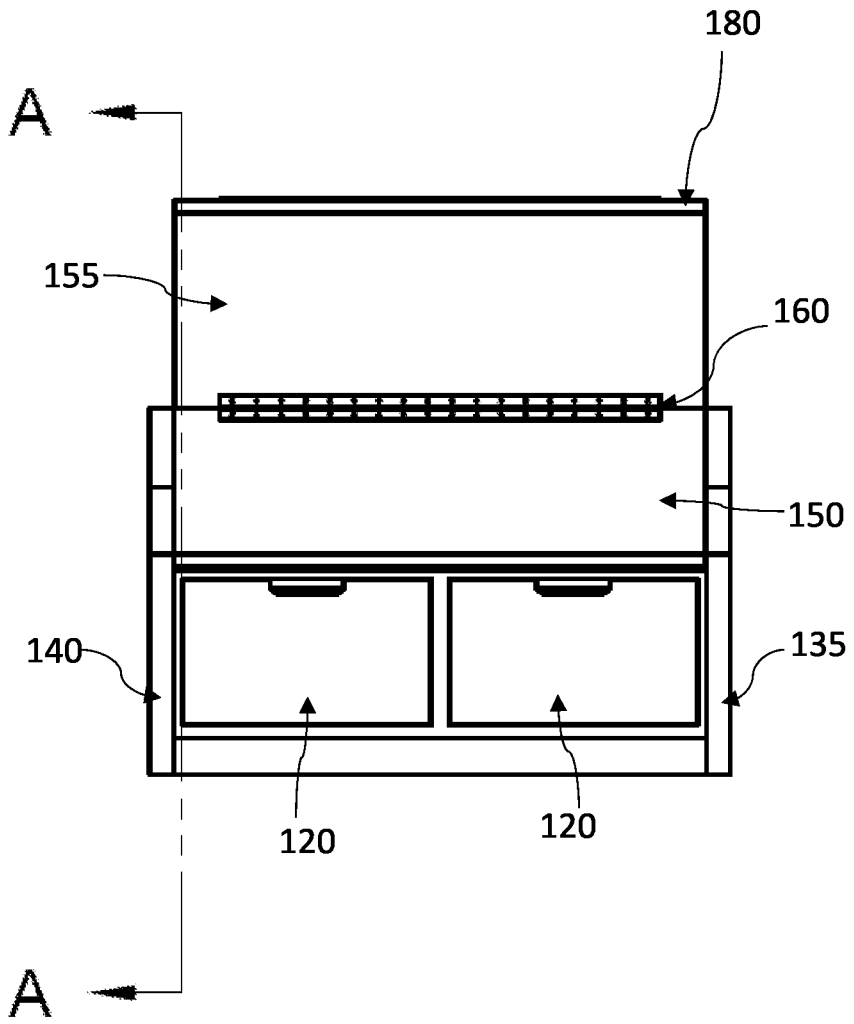
FIG. 5 is a front view of the convertible furniture item, according to an exemplary embodiment of the present invention.
Figure 5A:
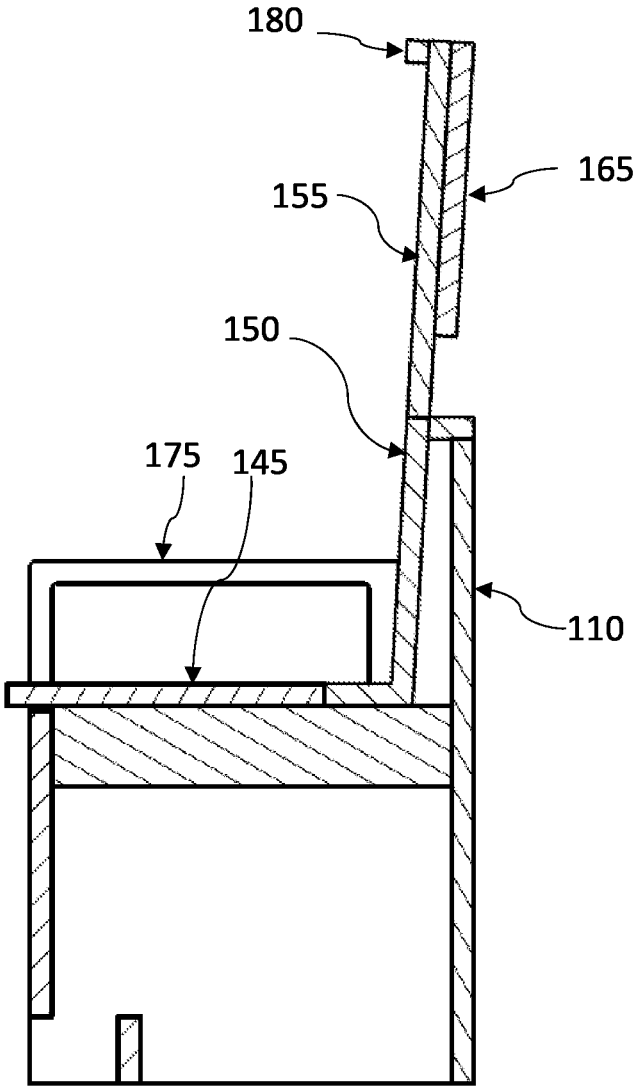
FIG. 5A is a cross-section view of the convertible furniture item taken along A-A in FIG. 5A, according to an exemplary embodiment of the present invention.
Figure 6:
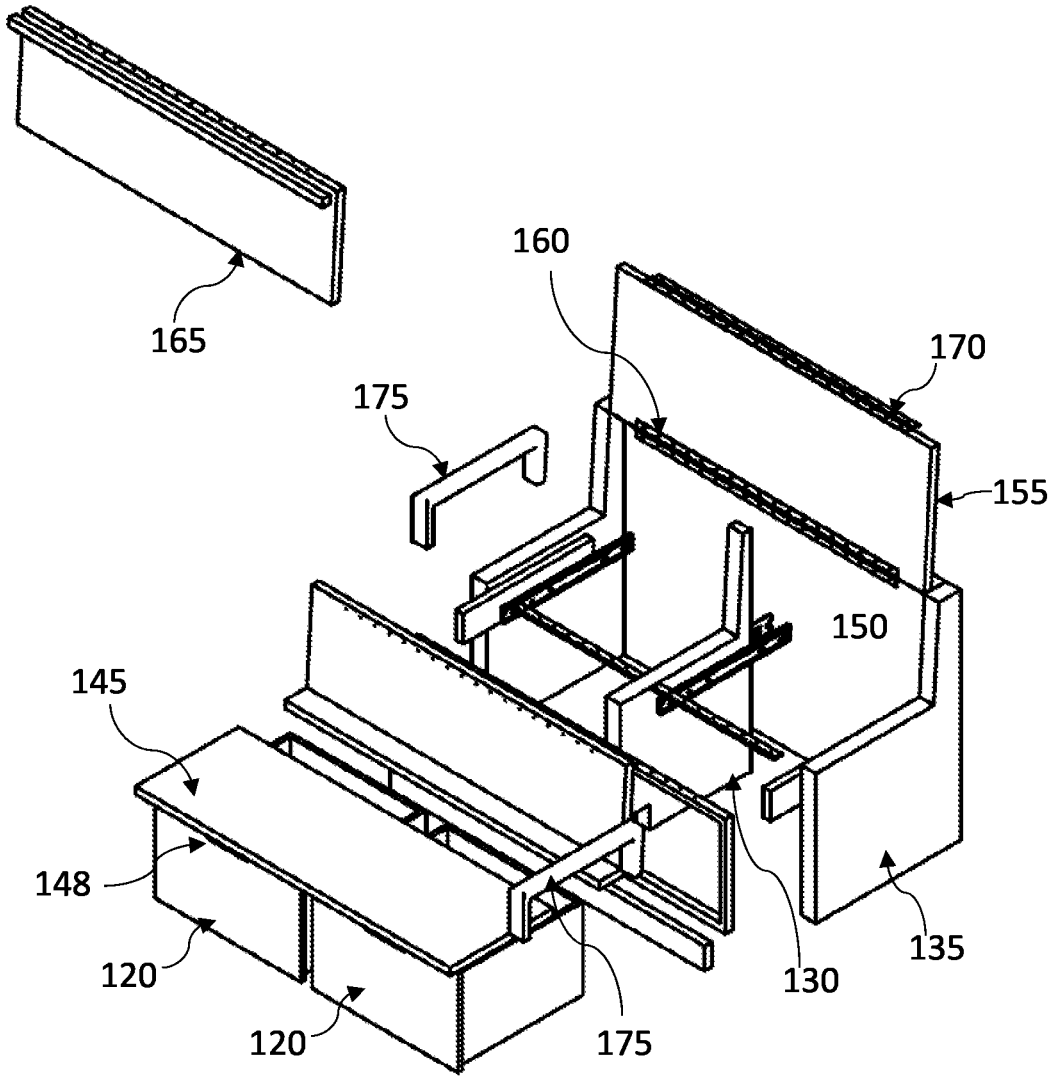
FIG. 6 is an exploded view of the convertible furniture item, according to an exemplary embodiment of the present invention.

Disclosed is a multi-functional, space-saving, economical furniture item, made of wood, that converts shape and function to provide storage, seating, a desk-top workspace, and a countertop-height workspace. The disclosed convertible furniture item can quickly and easily be transformed between a bench and a table. A single person can transform the sitting bench to a counter-top height table and vice versa with one hand and without significant force or effort. Referring to FIGS. 1-6, which show an exemplary embodiment of the convertible furniture item 100 that includes an enclosure 110. The length of the enclosure can be proportional to the seating capacity of the bench. Sitting capacity of more than one is within the scope of the present invention, however, the preferable number of seats can be one, two, or three. Also, it is understood that the terms "bench", "sitting bench", and "chair" are interchangeably used herein. Similarly, the terms "table" and "desk" are interchangeably used. A height of the enclosure 110 can be proportional to a height of the base of the bench on which a person can sit. The enclosure 110 is also be referred to herein as the frame 110. The enclosure 110 can have one or more drawers 120 slidably inserted into the enclosure 110. The drawers 120 can be used as storage. It is understood that two or more enclosures can be provided joined to each other and each enclosure can have a separate drawer. FIG. 1 shows two drawers 120 separated by a central support panel 130 (FIG. 4A). At the ends of enclosure 110 can be seen two side panels i.e., a left-side panel 140 and a right-side panel 135. A seat flap panel 145 can be mounted above the enclosure 110, wherein the enclosure can provide horizontal support for the seat flap panel 145. The seat flap panel 145 forms a seating area, i.e., surface over which a person can sit. The seat flap panel 145 can extend across the length of the enclosure and is made from a sturdy material such as wood. The seat flap panel 145 at its front side can be mounted to the enclosure 110 through a hinge joint 148 such that a rear side of the seat flap panel 145 can pivot upwards and outwards to an upright position. FIG. 2 shows the direction of pivoting the seat flap panel 145 by an arrow "A" pointing upwards and outwards. The pivoting of the seat flap panel 145 can be limited up to the upright position.

FIG. 1 shows the disclosed convertible furniture 100 in the form of the bench that can be transformed into the table as shown in FIG. 2 by the three arrows "A", "B", and "C". The convertible furniture 100 can also include a backrest divided into a lower backrest 150 and an upper backrest 155. The lower backrest 150 can be fixed to the right-side panel 135, the left-side panel 140, and the center support panel 130. The upper backrest 155 can be pivotally coupled to the lower backrest 150 through a second hinge joint 160. The second hinge joint 160 permits the upper backrest 155 to pivot outwards and toward the seat flap panel 145 and rest against the seat flap panel 145 in the upright position. Both the seat flap panel and the upper backrest can be turned clockwise as shown in FIG. 2. The top corner of the seat flap panel 145 can juxtapose to the upper backrest 155 and a stopper block 180 wherein the stopper block 180 prevents the seat flap panel 145 to return from the upright position to the horizontal position.

As shown in FIG. 2, to transform the convertible furniture 100 from the bench as shown in FIG. 2 to the table shape, first the seat flap panel 145 can be lifted upwards and outwards in the direction shown by arrow "A". A user can grab by hand a side of the seat flap panel 145 to lift it outwards to the upright position. Optionally, a handle can also be provided near the rear side of the seat flap panel 145 adjacent to the lower backrest 150, such that the handle can be grabbed for lifting the seat flap panel 145 to the upright position. It is understood, that if the handle is provided, the position of the handle can be such that it does not pinch a person sitting on the bench. Upon pivoting the seat flap panel 145 to the upright position, the upper backrest 155 can be turned forward and towards the seat flap panel 145 in a direction shown by the arrow "B". The upper backrest 155 can rest against the seat flap panel 145 that is already in the upright position to form the table, wherein a rear surface of the upper backrest 155 can act as a top surface of the tabletop while the seat flap panel 145 can act as a leg for the tabletop. The stopper block 180 can lock the seat flap panel 145 in the upright position by acting as a barrier against the inward pivoting of the seat flap panel 145. The area of the tabletop can be increased by providing an extension panel 165 coupled to upper backrest 155 through a third hinge joint 170. The extension panel can pivot 180 degrees in the direction of the arrow "C". When the upper backrest 155 is placed over the seat flap panel 145 that is in the upright position, the extension panel can be further pivoted outwards away from the lower backrest 150 about 180 degrees to form an extended tabletop. Thus, the seat flap panel 145, the upper backrest 155, and the extension panel 165 can be moved by a single hand to transform the convertible furniture 100 between the bench and table. To transform the table to bench, the extension panel 165 can be turned back upon the upper backrest 155, thereafter the upper backrest 155 can be moved back followed by the seat flap panel 145 from the upright position to the horizontal position. The backrest in the bench form can provide back support to a person sitting on the bench. FIG. 1 also shows two armrests 175 each coupled to the right-side panel 135 and the left-side panel 140.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A convertible furniture item that can transform between a sitting bench and a table, the convertible furniture item comprising:

a frame comprising a left side panel, a right side panel, and a horizontal support that extends between the left side panel and the right side panel, the horizontal support has a proximal end and a distal end;

a seat flap panel mounted to the horizontal support, wherein a front side of the seat flap panel is pivotally coupled to the proximal end of the horizontal support such that the seat flap panel can pivot from a horizontal position upwards and outwards to an upright position, the seat flap panel has a top surface and a bottom surface, wherein the top surface of the seat flap panel forms a seat of the sitting bench; and a backrest comprising an upper backrest panel and a lower backrest panel, wherein the upper backrest panel and the lower backrest panel are co-planar, wherein the backrest is configured to support a back of a person sitting on the sitting bench, the lower backrest panel fixedly coupled to the distal end of the horizontal support, the upper backrest panel has a top side and a bottom side, the bottom side of the upper backrest panel pivotally coupled to a top side of the lower backrest panel such that the upper backrest panel can be turned and placed on a rear side of the seat flap panel in the upright position, wherein the upper backrest panel is configured to form a tabletop of the table, and wherein the convertible furniture item further comprises an extension panel pivotally coupled to the top side of the upper backrest panel, the extension panel configured to be turned outwards 180 degrees to form an extended tabletop.

2. The convertible furniture item according to claim 1, wherein the seat flap panel is pivotally coupled to the horizontal support through a first hinge joint.

3. The convertible furniture item according to claim 2, wherein the upper backrest panel is pivotally coupled to the lower backrest panel through a second hinge joint.

4. The convertible furniture item according to claim 3, wherein the extension panel is pivotally coupled to the upper backrest panel through a third hinge joint.

5. The convertible furniture item according to claim 4, wherein the upper backrest panel further comprises a stopper block positioned adjacent to the top side of the upper backrest panel and extends along a length of the upper backrest panel, wherein the stopper block is configured to juxtapose to the upper surface of the seat flap panel when the seat flap panel is in the upright position and the upper backrest panel is placed upon the rear side of the seat flap panel, wherein the stopper block prevents an outward movement of the seat flap panel from the upright position to the horizontal position.

6. The convertible furniture item according to claim 5, wherein the convertible furniture item further comprises a left armrest coupled to the left-side panel and a right armrest coupled to the right-side panel.

7. The convertible furniture item according to claim 6, wherein the convertible furniture item further comprises one or more storage compartments mounted within the frame.

8. The convertible furniture item according to claim 7, wherein the one or more storage compartments comprise one or more drawers slidably mounted into the frame and below the horizontal support.

9. A method of transforming a convertible furniture item between a sitting bench and a table, the method comprising the steps of:

providing the convertible furniture item comprising:

a frame comprising a left side panel, a right side panel, and a horizontal support that extends between the left side panel and the right side panel, the horizontal support has a proximal end and a distal end, a seat flap panel mounted to the horizontal support, wherein a front side of the seat flap panel is pivotally coupled to the proximal end of the horizontal support such that the seat flap panel can pivot from a horizontal position upwards and outwards to an upright position, the seat flap panel has a top surface and a bottom surface, wherein the top surface of the seat flap panel forms a seat of the sitting bench, and a backrest comprising an upper backrest panel and a lower backrest panel, wherein the upper backrest panel and the lower backrest panel are co-planar, wherein the backrest is configured to support a back of a person sitting on the sitting bench, the lower backrest panel fixedly coupled to the distal end of the horizontal support, the upper backrest panel has a top side and a bottom side, the bottom side of the upper backrest panel pivotally coupled to a top side of the lower backrest panel such that the upper backrest panel can be turned and placed on a rear side of the seat flap panel in the upright position by pivoting the seat flap panel from the horizontal position to the upright position, wherein the upper backrest panel is configured to form a tabletop of the table; and upon pivoting the seat flap panel, pivoting the upper backrest panel to place the upper backrest panel upon the rear side of the seat flap panel, wherein the convertible furniture item further comprises an extension panel pivotally coupled to the top side of the upper backrest panel, the extension panel configured to be turned outwards 180 degrees to form an extended tabletop, and wherein the method further comprises the steps of:

upon placing the upper backrest panel, turning the extension panel to form the extended tabletop.

10. The method according to claim 9, wherein the seat flap panel is pivotally coupled to the horizontal support through a first hinge joint.

11. The method according to claim 10, wherein the upper backrest panel is pivotally coupled to the lower backrest panel through a second hinge joint.

12. The method according to claim 11, wherein the extension panel is pivotally coupled to the upper backrest panel through a third hinge joint.

13. The method according to claim 12, wherein the upper backrest panel further comprises a stopper block positioned adjacent to the top side of the upper backrest panel and extends along a length of the upper backrest panel, wherein the stopper block is configured to juxtapose to the upper surface of the seat flap panel when the seat flap panel is in the upright position and the upper backrest panel is placed upon the rear side of the seat flap panel, wherein the stopper block prevents an outward movement of the seat flap panel from the upright position to the horizontal position.

14. The method according to claim 13, wherein the convertible furniture item further comprises a left armrest coupled to the left-side panel and a right armrest coupled to the right-side panel.

15. The method according to claim 14, wherein the convertible furniture item further comprises one or more storage compartments mounted within the frame.

16. The method according to claim 15, wherein the one or more storage compartments comprise one or more drawers slidably mounted in the frame and below the horizontal support.

* * * * *